US009764366B2

(12) United States Patent
Higashida et al.

(10) Patent No.: US 9,764,366 B2
(45) Date of Patent: Sep. 19, 2017

(54) METHOD FOR REGENERATING A PLUG FOR USE IN A PIERCING MACHINE

(71) Applicant: NIPPON STEEL & SUMITOMO METAL CORPORATION, Tokyo (JP)

(72) Inventors: Yasuto Higashida, Tokyo (JP); Yasuyoshi Hidaka, Tokyo (JP); Kazuhiro Shimoda, Tokyo (JP); Yosuke Tatebayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 297 days.

(21) Appl. No.: 14/391,053

(22) PCT Filed: Mar. 4, 2013

(86) PCT No.: PCT/JP2013/055854

§ 371 (c)(1),
(2) Date: Oct. 7, 2014

(87) PCT Pub. No.: WO2013/153878

PCT Pub. Date: Oct. 17, 2013

(65) Prior Publication Data

US 2015/0140208 A1 May 21, 2015

(30) Foreign Application Priority Data

Apr. 11, 2012 (JP) ..... 2012-090120
May 9, 2012 (JP) ..... 2012-107275

(51) Int. Cl.
*B21B 28/00* (2006.01)
*B21B 19/04* (2006.01)
(Continued)

(52) U.S. Cl.
CPC ..... *B21B 28/00* (2013.01); *B05D 1/02* (2013.01); *B05D 3/12* (2013.01); *B21B 19/04* (2013.01); *B21B 25/00* (2013.01)

(58) Field of Classification Search
CPC ... A61L 2/00; B21D 9/01; F16L 13/02; B21B 19/04
(Continued)

(56) References Cited

U.S. PATENT DOCUMENTS 5,778,714 A 7/1998 Katsumura et al.
2003/0054090 A1* 3/2003 Hansen ..... A61L 2/08 427/2.1
(Continued)

FOREIGN PATENT DOCUMENTS

CN 101848777 9/2010
CN 102284777 12/2011
(Continued)

*Primary Examiner* — Dah-Wei D Yuan
*Assistant Examiner* — Andrew Bowman
(74) *Attorney, Agent, or Firm* — Clark & Brody

(57) ABSTRACT

It is an objective to provide a plug capable of enhancing a usage count of the plug, which is for use in a piercing machine for piercing-rolling a billet, and a regenerating method of the plug. The plug (10) is for use in a piercing machine (30) for piercing-rolling a billet (36). The plug (10) includes a body (18), a columnar portion (20), and a sprayed film (16). The body (18) has a maximum diameter at its rear end. The columnar portion (20) has the same diameter as the diameter of the rear end of the body (18), and extends from the rear end of the body (18). The sprayed film (16) is formed on a surface of the body (18) and on a surface of the columnar portion (20).

5 Claims, 9 Drawing Sheets

(51) Int. Cl.

| | |
|---|---|
| ***B21B 25/00*** | (2006.01) |
| ***B05D 1/02*** | (2006.01) |
| ***B05D 3/12*** | (2006.01) |

(58) Field of Classification Search
USPC ..... 427/2.1; 72/466.2, 97; 285/50
See application file for complete search history.

(56) References Cited

U.S. PATENT DOCUMENTS

| | | | | |
|---|---|---|---|---|
| 2007/0022796 | A1* | 2/2007 | Hayashi | B21B 23/00 72/97 |
| 2009/0071221 | A1* | 3/2009 | Iida | B21B 17/04 72/466.2 |
| 2015/0075241 | A1 | 3/2015 | Yamamoto et al. | |

FOREIGN PATENT DOCUMENTS

| | | |
|---|---|---|
| EP | 2 404 680 | 1/2009 |
| JP | 59-13924 | 4/1984 |
| JP | 62-244505 | 10/1987 |
| JP | 63-203205 | 8/1988 |
| JP | 64-7147 | 2/1989 |
| JP | 04-8498 | 2/1992 |
| JP | 04-74848 | 3/1992 |
| JP | 04-147706 | 5/1992 |
| JP | 04-270003 | 9/1992 |
| JP | 09-029310 | 2/1997 |
| JP | 10-180315 | 7/1998 |
| JP | 2976858 | 9/1999 |
| JP | 4279350 | 3/2009 |

* cited by examiner

METHOD FOR REGENERATING A PLUG FOR USE IN A PIERCING MACHINE

TECHNICAL FIELD

The present invention relates to a plug for use in a piercing machine and a regenerating method of a plug and, more particularly, to a plug for use in a piercing machine and a regenerating method of producing a plug by using a used plug.

BACKGROUND ART

Piercing machines are used in manufacturing seamless steel pipes in the Mannesmann process. A piecing machine includes a pair of skew rolls and a plug. The plug is disposed between the pair of the skew rolls, and is located on a pass line. The piercing machine pushes and squeezes a billet over the plug while rotating the billet in the circumferential direction with the skew rolls, so as to piercing-roll the billet into a hollow shell.

The piercing machine piercing-rolls a billet heated at a high temperature. Hence, the plug over which the billet is pushed and squeezed is subjected to a high temperature and a high pressure. Consequently, melting loss and scoring are likely to be caused to the plug.

In general, oxide scale is formed on the surface of a plug base metal. Such an oxide scale blocks heat from the billet so as to reduce generation of the melting loss. The oxide scale also reduces generation of the scoring.

Unfortunately, the oxide scale is gradually reduced every time the billet is piercing-rolled. If the oxide scale is exhausted, the temperature of the plug base metal begins to increase, which causes the melting loss to the plug.

In order to enhance the usage count of the plug, it has been proposed not only to form a scale on the surface of the plug base metal, but also to adjust a chemical composition of the base metal (see JP4-8498B, JP4-74848A, JP4-270003A, and JP64-7147B, for example).

In order to enhance the usage count of the plug, it has been proposed to form a coating other than the scale on the surface of the plug base metal (see JP10-180315A, and JP4279350B, for example).

DISCLOSURE OF THE INVENTION

Recently, further enhancement of the usage count of a plug has been desired.

A method of regenerating a plug on which melting loss occurs is disclosed in JP2976858B. In JP2976858B, the plug has a parallel portion. The parallel portion has the same diameter as the maximum diameter of the plug, and extends rearward from the portion at the maximum diameter. In such a plug, the portion at the maximum diameter is shifted rearward when cutting a front end portion of the plug on which melting loss occurs.

Unfortunately, the oxide scale is formed on the surface of the plug base metal in JP2976858B. The oxide scale is formed by eroding the base metal. Accordingly, as the oxide scale becomes worn away, the maximum diameter of the plug gradually becomes reduced. For this reason, the usage count of the plug should be limited.

The objective of the present invention is to provide a plug and a regenerating method of a plug capable of enhancing the usage count of the plug, which is for use in a piercing machine of piercing-rolling a billet.

A plug according to an aspect of the present invention is for use in a piercing machine for piercing-rolling a billet. The plug includes a body, a columnar portion, and a sprayed film. The body has a maximum diameter at its rear end. The columnar portion has the same diameter as the diameter of the rear end of the body, and extends from the rear end of the body. The sprayed film is formed on the surface of the body, and on the surface of the columnar portion.

A regenerating method of the plug according to another aspect of the present invention includes a preparing step, a cutting step, and a forming step. In the preparing step, a plug used in the piercing-rolling is prepared. In the cutting step, the plug is cut, so as to remove the sprayed film, and the body is shifted more rearward compared to the plug before the cutting. In the forming step, the sprayed film is newly formed on the surface of the body, and on the surface of the columnar portion after the cutting.

According to the plug and the regenerating method of the plug of the embodiments of the present invention, the usage count of the plug is enhanced.

MODE FOR CARRYING OUT THE INVENTION

Figure 1:
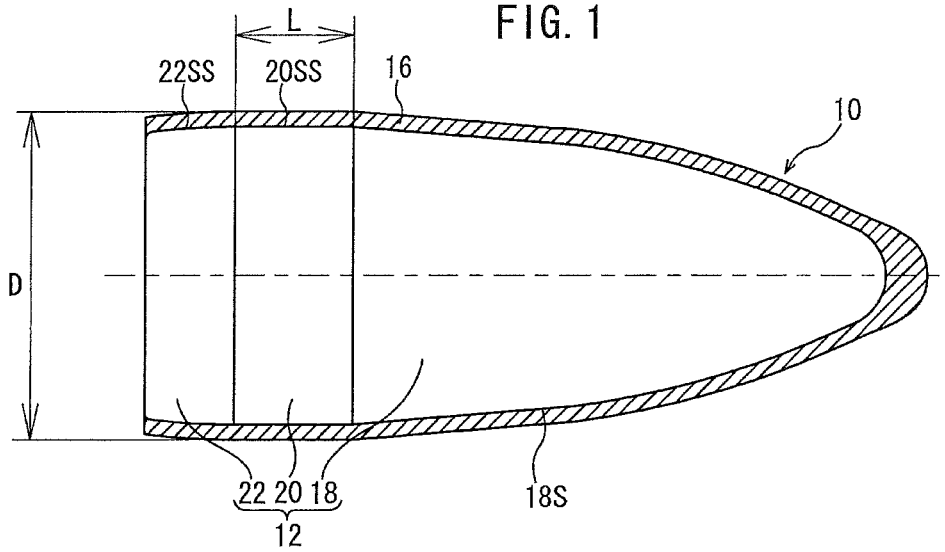
FIG. 1 is a longitudinal section view of a plug according to a first embodiment of the present invention.

A plug according to an embodiment of the present invention is for use in a piercing machine to piercing-roll a billet. The plug includes a body, a columnar portion, and a sprayed film. The body has the maximum diameter at the rear end thereof. The columnar portion has the same diameter as that of the rear end of the body, and extends from the rear end of the body. The sprayed film is formed on the surface of the body, and also on the surface of the columnar portion.

The sprayed film has a greater hot strength than that of an oxide scale. Accordingly, the plug according to an embodiment of the present invention becomes harder to be worn away compared to a plug having the oxide scale formed on its surface. As a result, the usage count of the plug becomes enhanced.

The columnar portion has the same diameter as that of the rear end of the body, and extends from the rear end of the body. If the body is melted, the melted portion is removed, and the columnar portion is cut so as to restore the shape and size of the body to its shape and size before the melting loss (to the original shape and size). Specifically, the axial direction length of the columnar portion is reduced, and the rear end of the body is shifted rearward, thereby restoring the body to have its original shape and size. This enhances the usage count of the plug.

It is preferable to further provide a build-up layer formed on the surface of the body. The sprayed film is formed on the surface of the body in a region more rearward than the build-up layer, and also formed on the surface of the columnar portion.

At the time of piercing-rolling the billet, the body of the plug comes in contact with the billet; thus the body is likely to be melted. For this reason, the build-up layer having a greater hot strength is formed on this portion likely to be melted. Accordingly, the hot strength of the body is enhanced; thus the body becomes unlikely to be melted.

To the contrary, scoring is more easily caused if the build-up layer is formed on the entire surface of the plug. To counter this, in the plug according to the embodiment, the sprayed film is formed on the side surface of the plug. The sprayed film is more excellent in scoring resistance than the build-up layer is. Hence, in the plug according to the embodiment, the build-up layer reduces the melting loss, and the sprayed film reduces the scoring. Accordingly, the usage count of the plug is enhanced.

If the build-up layer is melted, the axial direction length of the columnar portion is reduced, so as to remove the melted portion, and to restore the shape and size from the front end to the portion at the maximum diameter of the plug to its shape and size before the melting loss (to its original shape and size). Specifically, the shape and size from the front end to the portion at the maximum diameter can be restored to its original shape and size by shifting the rear end of the body rearward. Accordingly, it is possible to enhance the usage count of the plug that is usable as a plug having the identical size.

The front end portion of the body is preferably covered with the build-up layer. In this configuration, the front end portion of the body becomes unlikely to be melted.

In the case of covering the front end portion of the body with the build-up layer, it is preferable that the thickness of the front end portion of the build-up layer is equal to or smaller than the axial direction length of the columnar portion. In this configuration, the plug may be cut immediately before the front end portion of the build-up layer becomes lost.

The body preferably includes a first body portion and a second body portion. The second body portion has a greater diameter than that of the rear end of the first body portion, and extends from the rear end of the first body portion. The build-up layer is formed on the surface of the first body portion. The sprayed film is formed on the surface of the second body portion.

In this case, even if the build-up layer is configured to have a greater thickness than that of the sprayed film, a step height is hardly formed at a boundary between the build-up layer and the sprayed film.

Preferably, the surface of the build-up layer is smoothly combined with the surface of the sprayed film. In this configuration, no step height is generated at the boundary between the build-up layer and the sprayed film, which prevents flaws from being generated on an internal surface of the hollow shell after the piercing-roll.

The sprayed film may cover the entire surface of the body.

The sprayed film is preferably formed of iron and iron oxide. In this configuration, the wear resistance of the sprayed film is enhanced.

The percentage of the iron oxide in the sprayed film formed of the iron and the iron oxide is preferably greater in portions of the sprayed film 16 close to the surface of the sprayed film than in portions of the sprayed film close to the body and to the columnar portion. This configuration further enhances the wear resistance of the sprayed film.

The regenerating method of the plug according to another embodiment of the present invention includes a preparing step, a cutting step, and a forming step. In, the preparing step, a plug used in the piercing-rolling is prepared. In the cutting step, this plug is cut, so as to remove the sprayed film, and the rear end of the body is shifted more rearward compared to the plug before the cutting. In the forming step, the sprayed film is newly formed on the surface of the body, and on the surface of the columnar portion after the cutting.

The plug used in the piercing-rolling has a worn sprayed film. A badly worn sprayed film may easily cause the melting loss to the plug. For this reason, the worn sprayed film is removed, and a new sprayed film is formed. The sprayed film does not erode the base metal (the body and the columnar portion) at the time of forming the film, which is different from the oxide scale. Accordingly, a new sprayed film is formed in the same thickness as that of the original sprayed film, which makes the maximum diameter of the plug equal to that of the original maximum diameter.

If the body is melted, the melted portion of the body is removed by cutting this melted portion. At this time, the columnar portion is cut, and the rear end of the body is shifted rearward, so as to restore the shape and size of the body to its original shape and size.

According to the above described regenerating method, it is possible to regenerate the plug having the same shape and size of the body as those of the plug before the melting loss by cutting the columnar portion. Since the body can be regenerated, a desirable hollow shell can be obtained even if the billet is piercing-rolled by using such a plug.

The sprayed film may cover the entire surface of the body. In such an implementation, in the forming step, a new sprayed film is formed on the entire surface of the body and on the surface of the columnar portion.

The regenerating method preferably further includes a step of performing a shotblast on the entire surface of the body and on the surface of the columnar portion before the forming step and after the cutting step. In this configuration, adhesiveness of the sprayed film is enhanced.

The plug preferably further includes a build-up layer formed on the surface of the body. The sprayed film is formed on the surface of the body in a region more rearward than the build-up layer, and on the surface of the columnar portion. In the forming step, a new sprayed film is formed on the surface of the body in regions other than the region where the build-up layer is formed, and on the surface of the columnar portion.

If the build-up layer is melted, the melted portion is cut and removed. At this time, the columnar portion is cut, and the rear end of the body is shifted rearward, so as to restore the shape and size from the front end to the portion at the maximum diameter of the plug to its original shape and size.

Specifically, the columnar portion is cut, thereby producing the plug having the shape and size from the front end to the portion at the maximum diameter, which is the same as the size and shape of the plug before the melting loss. Since the shape and size from the front end to the portion at the maximum diameter of the plug can be regenerated, a desirable hollow shell can be obtained even if the billet is piercing-rolled by using such a plug.

The regenerating method preferably further includes a step of performing a shotblast on the surface of the body in a region more rearward than the build-up layer, and also on the surface of the columnar portion before the forming step and after the cutting step. This configuration enhances the adhesiveness of the sprayed film.

Hereinafter, description will be provided on the plug and the regenerating method of the plug according to the embodiments of the present invention with reference to the drawings. The same structural elements in the drawings are designated by the same reference numerals and their detail description is omitted.

First Embodiment

FIG. 1 is a longitudinal section view of a plug 10 according to a first embodiment of the present invention. As shown in FIG. 1, the plug 10 includes a plug body 12, and a sprayed film 16.

The plug body 12 includes a body 18, a columnar portion 20, and a rear end portion 22.

The body 18 includes a front end portion of the plug body 12. The body 18 has a circular cross section. The diameter of the body 18 gradually becomes increased from the front end to the rear end of the plug 10. The diameter at the rear end of the body 18 is the maximum diameter of the plug body 12.

The columnar portion 20 has the same diameter as that of the rear end of the body 18, and extends from the rear end of the body 18 in the axial direction of the plug 10. Specifically, the columnar portion 20 has the same diameter as the maximum diameter of the body 18. An axial direction length L of the columnar portion 20 is 3 mm at least, for example.

If the front end of the body 18 is melted, the columnar portion 20 is cut, and the body 18 is shifted rearward, so as to remove the melted portion. In this case, the length of the columnar portion 20 becomes reduced, but the shape and size of the body 18 is regenerated to its original shape and size.

The rear end portion 22 extends from the rear end of the columnar portion 20 in the axial direction of the plug 10. The diameter of the rear end portion 22 gradually becomes reduced from the front end toward the rear end of the plug 10.

[Protective Film of Plug Body]

The sprayed film 16 is formed on the surface of the above described plug body 12.

[Sprayed Film]

The sprayed film 16 is formed on a surface 18S of the body 18, and on a surface (side surface) 20SS of the columnar portion 20. As shown in FIG. 1, the sprayed film 16 is formed not only on the surface 18S of the body 18 and the surface (side surface) 22SS of the columnar portion 20, but also on a side surface 22SS of the rear end portion 22.

The sprayed film 16 is formed by a well-known spraying process such as an arc spraying, a plasma spraying, a flame spraying, and a high-speed flame spraying. The thickness of the sprayed film 16 is 400 μm to 1200 μm, for example.

A shotblast may be applied to the surface of the plug body 12 (the surface 18S of the body 18, the side surface 20SS of the columnar portion 20, and the side surface 22SS of the rear end portion 22) on which the sprayed film 16 is to be formed before the sprayed film 16 is formed. Through this configuration, the surface of the plug body 12 becomes rough, and the adhesiveness of the sprayed film 16 is enhanced.

The sprayed film 16 does not necessarily have a constant thickness. For example, the front end of the sprayed film 16 has a greater thickness than that of the other portions thereof.

The chemical composition of the sprayed film 16 is not limited to a specific one. The sprayed film 16 preferably contains iron (Fe) and iron oxide (such as $Fe_3O_4$ and FeO). In this case, the sprayed film 16 is formed by arc-spraying an iron wire rod, for example. The sprayed film 16 may further contain oxide other than the iron oxide (such as tungsten oxide ($WO_3$)).

The percentage of the iron oxide in the sprayed film 16 formed of the iron and the iron oxide is preferably 55 to 80% by volume. The percentage of the iron oxide in the sprayed film 16 is greater in portions of the sprayed film 16 close to the surface of the sprayed film 16 than in portions of the sprayed film 16 close to the body 18 and to the columnar portion 20, for example. In this case, the percentage of the iron oxide in the sprayed film 16 is 40% by volume at most at the boundary to the plug body 12, and 55 to 80% by volume on the outer layer of the sprayed film 16, for example. The percentage of the iron oxide in the sprayed film 16 may be changed by changing a distance from a spray nozzle of an arc spraying device to the plug body 12 (spraying distance), for example.

Figure 2:
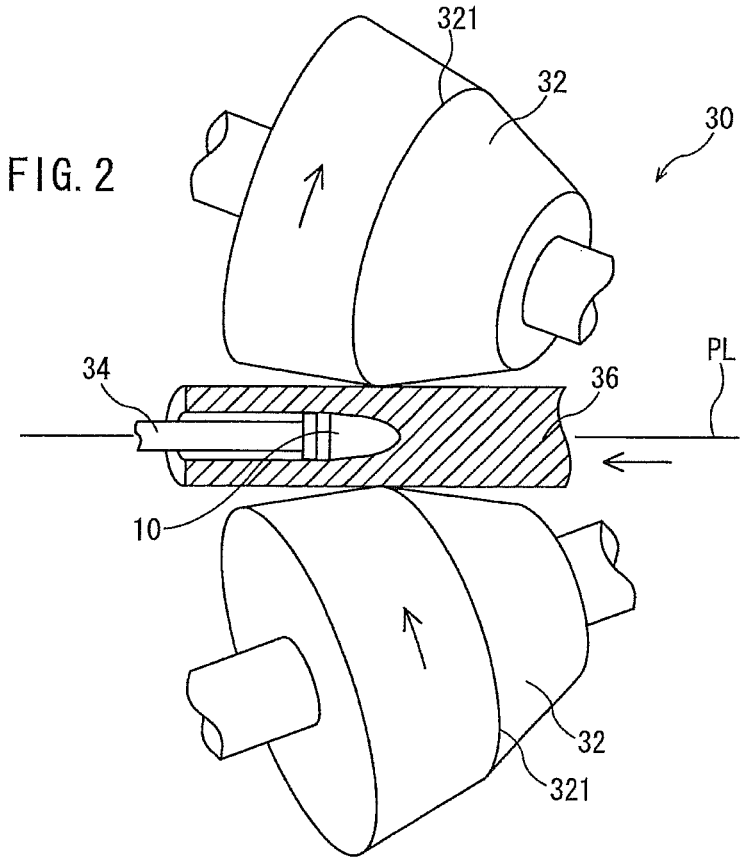
FIG. 2 is a schematic diagram showing a configuration of a piercing machine in which the plug of FIG. 1 is used.

FIG. 2 is a schematic diagram showing a configuration of a piercing machine 30 equipped with the plug 10. In the piercing machine 30, the plug 10 is attached to a front end of a mandrel 34, is disposed between a pair of skew rolls 32, 32, and is located on a pass line PL. A billet 36 is squeezed over the plug 10 during the piercing-rolling. At this time, the plug 10 is subjected to a high temperature and a high pressure.

The sprayed film 16 is formed on the surface of the plug 10. The sprayed film has a hot strength greater than that of the oxide scale. Hence, the plug 10 becomes harder to be worn away than a plug, the surface on which the oxide scale is formed. In other words, the usage count of the plug 10 is enhanced.

The sprayed film 16 is preferably formed of the iron and the iron oxide. In this configuration, the wear resistance of the sprayed film 16 is enhanced.

The percentage of the iron oxide in the sprayed film 16 formed of the iron and the iron oxide is preferably greater in portions of the sprayed film 16 close to the surface of the sprayed film 16 than in the portions thereof close to the body 18 and the columnar portion 20. Through this configuration, the wear resistance of the sprayed film 16 is further enhanced.

As described above, the plug 10 is subjected to a high temperature and a high pressure during piercing-rolling of the billet 36. Consequently, repetitive usage of the plug 10 may cause abrasion to the sprayed film 16, and the melting loss at the front end portion of the plug 10.

[Regenerating Method of Plug]

The above described plug (plug used in the piercing-roll: referred to as a used plug, hereinafter) can be reused through the following regenerating method.

Figure 3A:
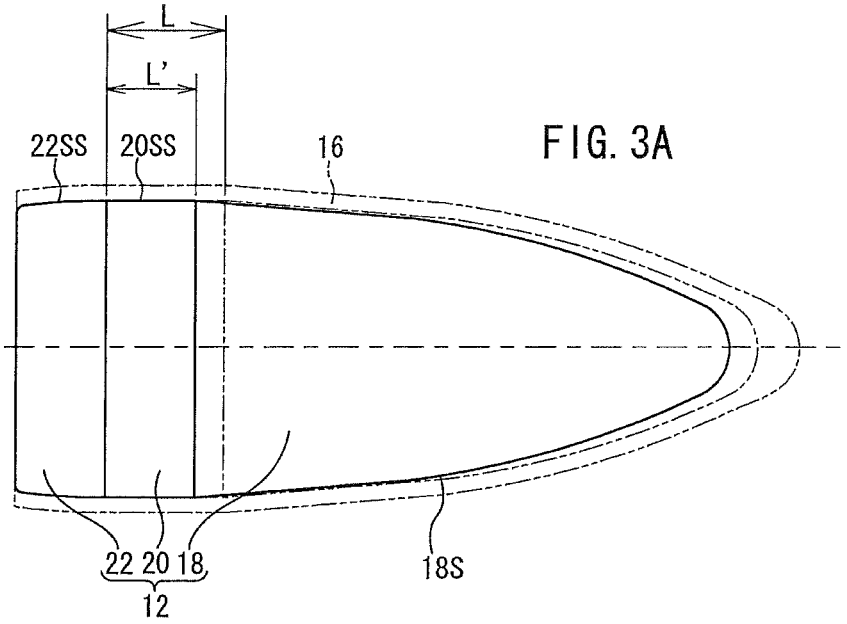
FIG. 3A is a longitudinal section view showing the plug after the cutting.

A used plug is first prepared (preparing step). The used plug is then cut, and the body 18 is shifted more rearward than its position before the cutting (cutting step). In these steps, the melted portion of the front end of the body 18 is removed, and the sprayed film 16 is also removed. In the cutting step, the plug body 12 is cut such that the original shape and size of the body 18 is maintained. At this time, the columnar portion 20 is cut, and the rear end of the body 18 is shifted toward the rear end of the columnar portion 20. As shown in FIG. 3A, the body 18 is regenerated into its original shape and size, and the axial direction length L of the columnar portion 20 is reduced to a length L'.

Thereafter, the shotblast is applied to the surface of the plug body 12 (processing step). In this step, the sprayed film 16 remaining on the surface of the plug body 12 is removed, and the surface of the plug body 12 becomes rough.

A new sprayed film 16 is formed in the region where the shotblast is applied (forming step). This means that the sprayed film 16 is newly formed on the surface of the plug body 12.

Figure 3B:
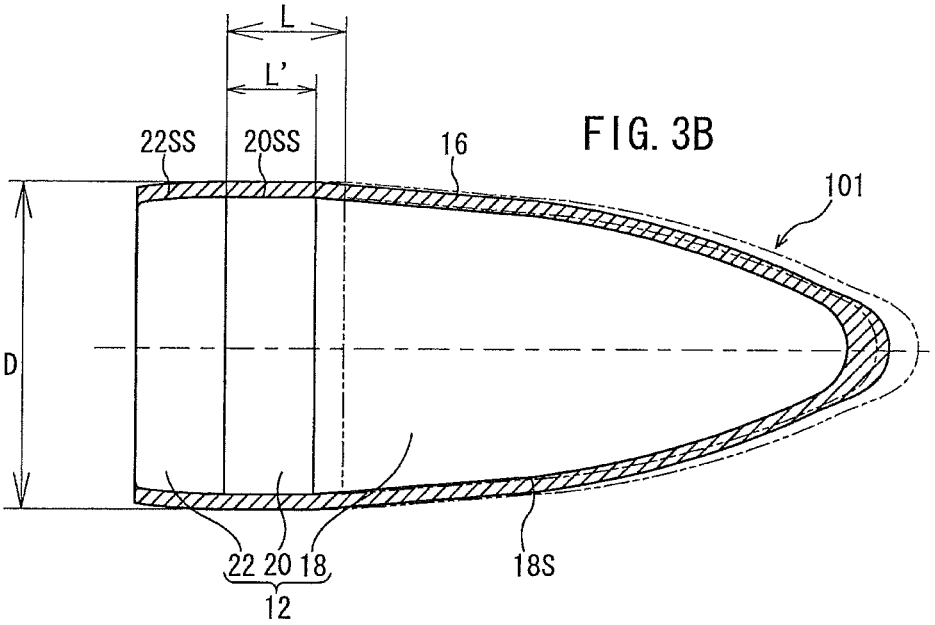
FIG. 3B is a longitudinal section view showing a regenerated plug.

Through the above steps, a plug 101 shown in FIG. 3B is produced. This plug 101 has a shorter axial direction length of the columnar portion 20 compared to that of the plug 10 shown in FIG. 1, but the shape and size of the body 18 is the same as those of the plug 10. If the newly formed sprayed film 16 has the same thickness as that of the previous sprayed film 16, the maximum diameter of the plug 101 becomes equal to that of the plug 10.

In the above regenerating method, it is possible to produce the plug 101 that has the same shape and size of the body 18 as those of the plug 10, and also has the same maximum diameter D as that of the plug 10.

With respect to enhancement of the wear resistance of the sprayed film 16, it is preferable that the sprayed film 16 is formed of the iron and the iron oxide, and the percentage of the iron oxide in the sprayed film 16 is greater in portions of the sprayed film 16 close to the surface of the sprayed film 16 than in the portions thereof close to the body 18 and the columnar portion 20. In this case, if a new sprayed film is formed on the worn sprayed film, the percentage of the iron oxide in the sprayed film 16 varies, that is, the percentage of the iron oxide becomes different from the percentage of the iron oxide in the original sprayed film 16. Consequently, the hot strength and the wear resistance of the sprayed film 16 are deteriorated.

To the contrary, in the present embodiment, as described above, the sprayed film 16 of the used plug is completely removed, which equals the percentage of the iron oxide between the newly formed sprayed film 16 and the original sprayed film 16. Specifically, the characteristics of the sprayed film 16 can be equal before and after the regeneration of the plug.

If the body 18 is melted, the plug body 12 is cut, and the body 18 is then shifted rearward. At this time, the axial direction length of the columnar portion 20 becomes reduced in accordance with the rearward moved distance of the body 18. This means that the plug can be regenerated if the rearward moved distance of the body 18 is shorter than the axial direction length of the columnar portion 20.

In the above described regenerating method, the shotblast is applied on the surface of the plug body 12 after the cutting, but this shotblast may be omitted.

Second Embodiment

Figure 4:
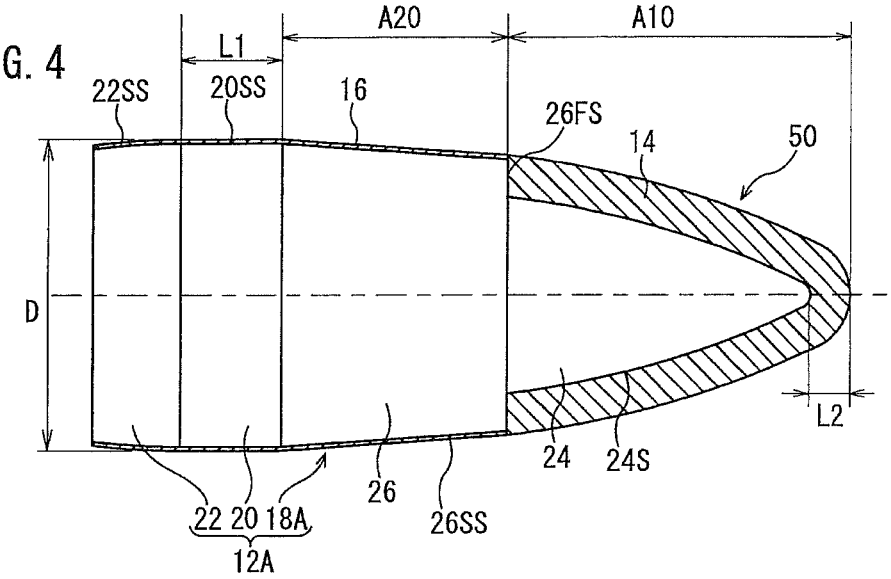
FIG. 4 is a longitudinal section view of a plug according to a second embodiment of the present invention.

FIG. 4 is a longitudinal section view of a plug 50 according to a second embodiment of the present invention. Compared to the plug 10, the plug 50 includes a plug body 12A instead of the plug body 12 (see FIG. 1). The plug 50 further includes a build-up layer 14. The other elements of the plug 50 are the same as those of the plug 10.

[Plug Body]

Compared to the plug body 12, the plug body 12A includes a body 18A instead of the body 18 (see FIG. 1). The body 18A includes a first body portion 24 and a second body portion 26.

The first body portion 24 includes a front end portion of the plug body 12A. The first body portion 24 has a circular cross section. The first body portion 24 has a diameter gradually increased from the front end toward the rear end of the plug 50.

The second body portion 26 has a greater diameter than that of the rear end of the first body portion 24. The second body portion 26 extends from the rear end of the first body portion 24 in the axial direction of the plug 50.

The second body portion 26 has a circular cross section, and the front end of the second body portion 26 has a greater diameter than that of the rear end of the first body portion 24. The second body portion 26 is disposed coaxial with the first body portion 24. Consequently, a step height is generated at the boundary between the second body portion 26 and the first body portion 24. A front end face 26FS of the second body portion 26 is annular.

The second body portion 26 has a diameter gradually increased from the front end toward the rear end of the plug 50. The diameter of the rear end of the second body portion 26 is the maximum diameter of the plug body 12A.

The axial direction length L1 of the columnar portion 20 is shorter than the sum of the axial direction length of a rolling portion A10 and the axial direction length of a reeling portion A20 of the plug 50. The rolling portion A10 takes charge of wall-thickness rolling reduction, and the reeling portion A20 finishes the wall thickness to be smooth.

If the front end of the plug 50, that is, the front end of the build-up layer 14 is melted, the melted portion is removed by reducing the axial direction length of the columnar portion 20 and shifting the rear end of the body 18A rearward. In this case, the columnar portion 20 becomes reduced, but the shape and size of the rolling portion A10 and the reeling portion A20 of the plug 50 can be regenerated into its original shape and size.

[Protective Films of Plug Body]

Different protective films (the build-up layer 14 and the sprayed film 16) are formed in the front portion and in the rear portion of the above described plug body 12A, respectively.

[Build-Up Layer]

The build-up layer 14 covers the circumference of the body 18A. In the example of FIG. 4, the build-up layer 14 covers a surface 24S of the first body portion 24. Specifically, in the example of FIG. 4, the build-up layer 14 covers the front end portion of the body 18A.

The build-up layer 14 is formed by a well-known build-up welding process such as a plasma transferred arc (PTA) welding, an MIG (metal inert gas) welding, and a TIG (tungsten insert gas) welding.

The build-up layer 14 has a thickness of 1 mm at least, for example. Preferably, the build-up layer 14 has a thickness of 1 to 20 mm, and more preferably 2 to 10 mm. If the thickness is to exceed 5 mm, a plurality of build-up layers may be formed, for example. Each layer has a thickness of 2 to 5 mm, for example. After a plurality of build-up layers are formed, the target entire thickness may be achieved by cutting away the surface of the topmost build-up layer. If the thickness is to be smaller than 2 mm, a build-up layer with a thickness of 2 mm or larger may be formed before the surface of the build-up layer is cut away to achieve the target thickness. If the build-up layer 14 is too thin, the hot strength may not be improved. If the build-up layer 14 is too thick, the build-up layer 14 may develop a crack. Moreover, forming such a build-up layer 14 may require a longer time, leading to increased manufacturing costs. The build-up layer 14 does not necessarily have a constant thickness. The thickness of the build-up layer 14 may be greater at the front end portion than that in the other portions thereof, for example.

In the example of FIG. 4, a thickness L2 of the front end portion of the build-up layer 14 is equal to the axial direction length L1 of the columnar portion 20 at most. In this configuration, such a problem can be avoided that the rear end of the body 18A cannot be shifted rearward if the melted portion of the build-up layer 14 is removed.

The diameter of the rear end of the build-up layer 14 is greater than the diameter of the front end of the second body portion 26.

The build-up layer 14 is formed of an alloy mainly containing a transition metal, for example. This alloy is an alloy (stellite alloy) containing cobalt (Co) as a main component, along with chrome (Cr) and tungsten (W), for example.

The build-up layer 14 may contain carbide of a transition metal. The carbide of the transition metal may be niobium carbide (NbC), tungsten carbide (WC), titanium carbide (TiC), vanadium carbide (VC), and chromium carbide (CrC), etc. The carbide of the transition metal of 20 to 50% by volume may be contained, for example. The average grain diameter of the carbide of the transition metal is 65 to 135 μm, for example.

[Sprayed Film]

The sprayed film 16 is formed on the surface of the body 18A in the regions other than a region where the build-up layer 14 is formed, and on the surface of the columnar portion 20. In the example of FIG. 4, the sprayed film 16 is formed on a side surface 26SS of the second body portion 26, a side surface 20SS of the columnar portion 20, and a side surface 22SS of the rear end portion 22. In the present embodiment, the thickness of the sprayed film 16 is 400 μm to 800 μm, for example.

In the example of FIG. 4, the diameter of the front end of the sprayed film 16 is equal to the diameter of the rear end of the build-up layer 14. Specifically, the surface of the build-up layer 14 is smoothly combined with the surface of the sprayed film 16.

The plug 50 shown in FIG. 4 is for use in the piercing machine 30 shown in FIG. 2. The billet 36 is squeezed over the plug 50 during the piercing-rolling. Consequently, the plug 50 is subjected to a high temperature as well as a high pressure.

The front end portion of the plug 50 is covered with the build-up layer 14. In the example of FIG. 4, the first body portion 24 and the build-up layer 14 covering the surface of the first body portion 24 agree with the rolling portion A10. This means that the surface of the rolling portion A10 is constituted by the build-up layer 14. The build-up layer has a higher hot strength than that of the sprayed film and the oxide scale. Accordingly, the rolling portion A10 including the front end portion of the plug 50 becomes unlikely to be melted even if the billet 36 is piercing-rolled with the rolling portion A10.

Figure 5:
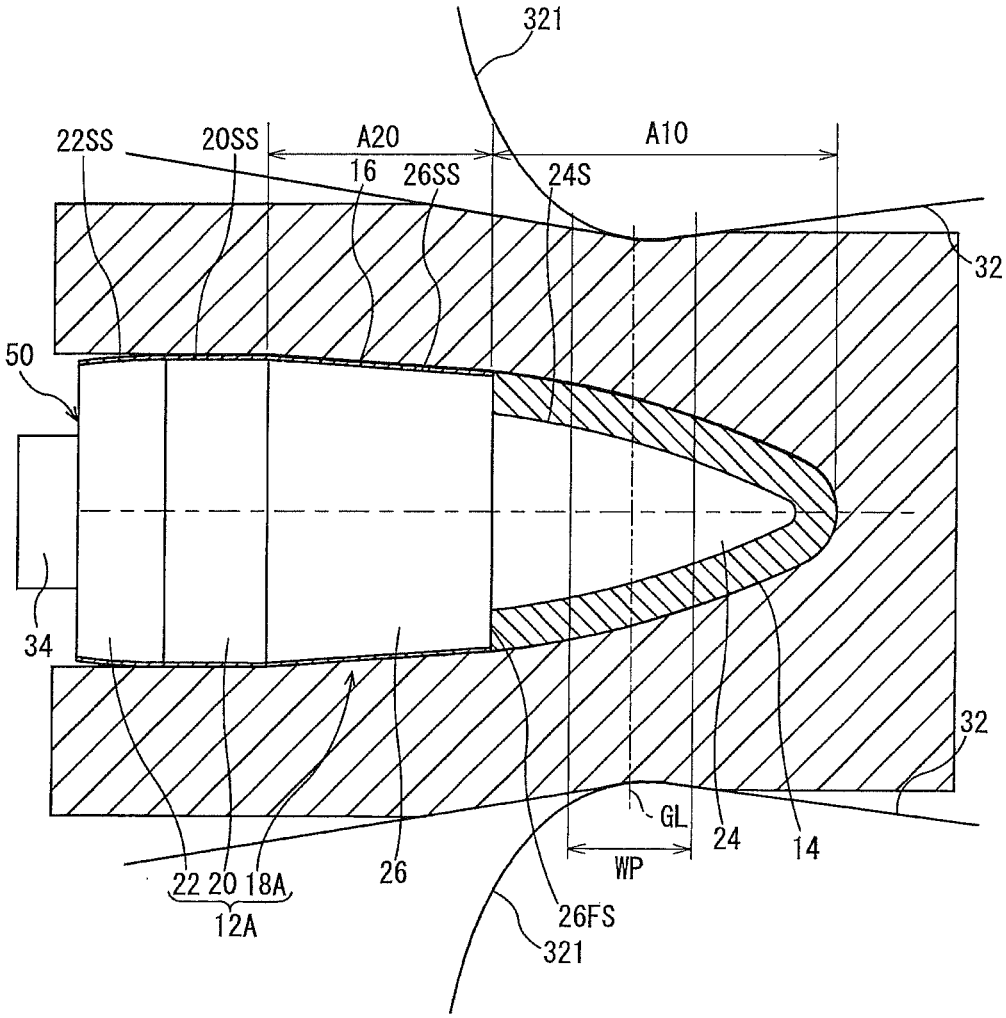
FIG. 5 is a schematic diagram showing a relation between a build-up layer on the plug of FIG. 4 and gorging portions of skew rolls.

In the example of FIG. 4, the first body portion 24 and the build-up layer 14 covering the surface of the first body portion 24 agrees with the rolling portion A10, but this may be unnecessary. The build-up layer 14 may be formed on a portion to be easily melted during the piercing-rolling of the billet. The rolling portion is likely to be melted, and the melting loss is likely to be generated particularly at the front end portion of the rolling portion, and in regions of the rolling portion that oppose gorging portions 321 of the skew rolls 32 (portions opposing the gorging portions in the direction perpendicular to the pass line PL). As shown in FIG. 5, the distance between the pair of skew rolls 32, 32 becomes the smallest at a position between the gorging portions 321, 321 (a position GL indicated by a dashed line in FIG. 5). In general, melting loss is likely to occur in a width WP extending several centimeters frontward and rearward (extending 3 cm frontward and rearward, respectively, for example) along the pass line direction from the position GL of the rolling portion that opposes the gorging portions 321. Accordingly, the build-up layer 14 is preferably formed at least in a region from the front end of the plug to a position more rearward by a predetermined distance (3 cm, for example) than the position GL. No build-up layer 14 is preferably formed on the reeling portion A20 for the purpose of preventing the scoring of the plug.

The sprayed film 16 is formed on the side surface other than the rolling portion A10 of the plug 50. This sprayed film has a greater scoring resistance than that of the build-up layer. Accordingly, the plug 50 is more unlikely to be scored compared to the case of covering the entire surface of the plug body 12A with the build-up layer.

As described above, in the plug 50, the build-up layer reduces the melting loss at the front end portion, and the sprayed film reduces the scoring. Accordingly, the life of the plug 50 becomes enhanced.

In general, the build-up layer is configured to have a greater thickness than that of the sprayed film. In the plug 50, the plug body 12A includes the first body portion 24 and the second body portion 26. The diameter at the rear end of the first body portion 24 is smaller than the diameter at the front end of the second body portion 26. Consequently, no step height is generated at the boundary between the surface of the build-up layer 14 and the surface of the sprayed film 16, so that the surface of the build-up layer 14 is smoothly combined with the surface of the sprayed film 16 in the plug 50. Accordingly, flaws are unlikely to be generated on an internal surface of a hollow shell obtained by piercing-rolling of the billet 36.

As described above, the plug 50 is subjected to a high temperature and a high pressure during the piercing-rolling of the billet 36. Hence, repetitive usage of the plug 50 may cause an abrasion to the sprayed film 16, or cause the melting loss at the front end portion of the build-up layer 14.

[Regenerating Method of Plug]

The above described plug (plug used in the piercing-rolling: referred to as a used plug, hereinafter) can be reused through the following regenerating method.

Figure 6A:
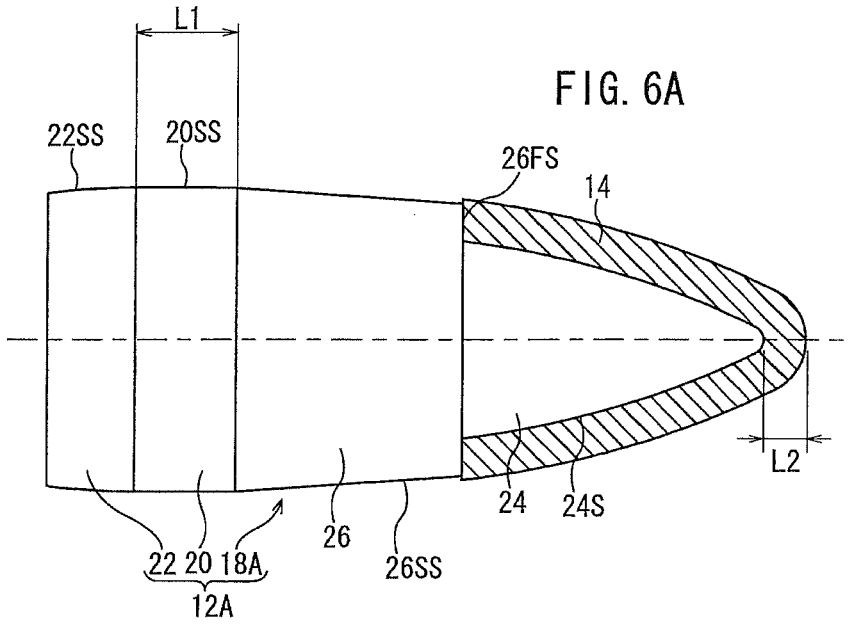
FIG. 6A is a longitudinal section view showing the plug body and the build-up layer after the sprayed film is removed.

A used plug is first prepared (preparing step). If the front end of the build-up layer 14 is not melted, the sprayed film 16 remaining on the surface of the used plug is removed (removing step). Specifically, the shotblast is applied to regions on the surface of the used plug other than a region where the build-up layer 14 is formed. In this step, the sprayed film 16 remaining on the surface of the used plug is removed, and the regions on the surface of the plug body 12A other than the region where the build-up layer 14 is formed become rough. FIG. 6A shows the plug (the plug body 12A and the build-up layer 14) from which the sprayed film 16 is removed.

Subsequently, a new sprayed film 16 is formed in the region where the shotblast is applied (forming step). This means that the sprayed film 16 is newly formed on the surface of the plug body 12A in the regions other than the region where the build-up layer 14 is formed. Through the above steps, the plug 50 shown in FIG. 4 is produced.

Figure 6B:
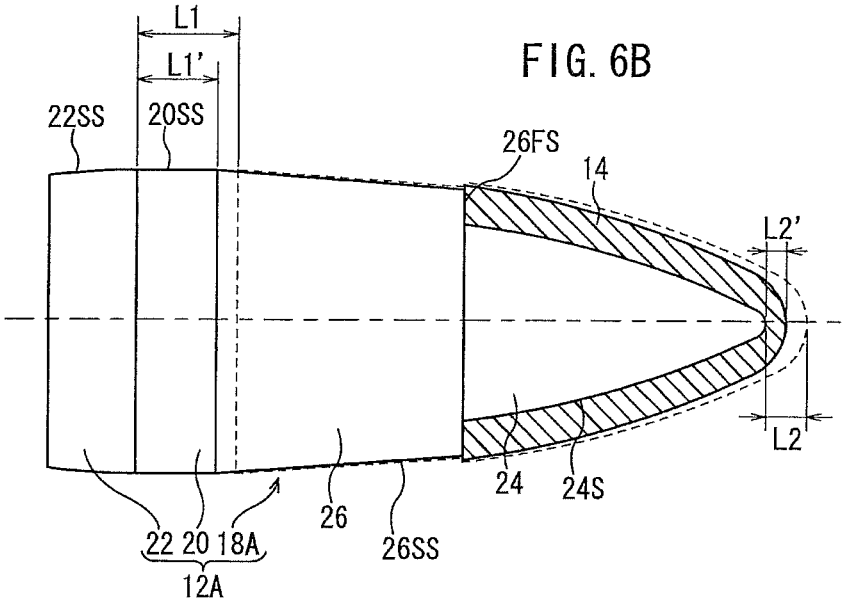
FIG. 6B is a longitudinal section view showing the plug body and the build-up layer after the cutting.

If the build-up layer 14 is melted, the used plug is cut, and the rear end of the body 18A is shifted more rearward than its position before the plug is cut (cutting step). In this step, the melted portion at the front end of the build-up layer 14 is removed, and the sprayed film 16 is also removed. In the cutting step, the used plug is cut such that the shape and size of the rolling portion A10 and the reeling portion A20 at the time of forming the new sprayed film 16 is maintained to be the original shape and size thereof. At this time, the columnar portion 20 becomes reduced, and the rear end of the body 18A is shifted toward the rear end of the columnar portion 20 (see FIG. 6B). The variation in the axial direction length of the columnar portion 20 (L1-L1') is equal to the variation in thickness of the front end portion of the build-up layer 14 (L2-L2').

Thereafter, the shotblast is applied to the regions on the surface of the plug body 12A other than the region where the build-up layer 14 is formed (processing step). In this step, the sprayed film 16 remaining on the surface of the used plug is removed, and the regions on the surface of the plug body 12A other than the region where the build-up layer 14 is formed become rough.

Figure 6C:
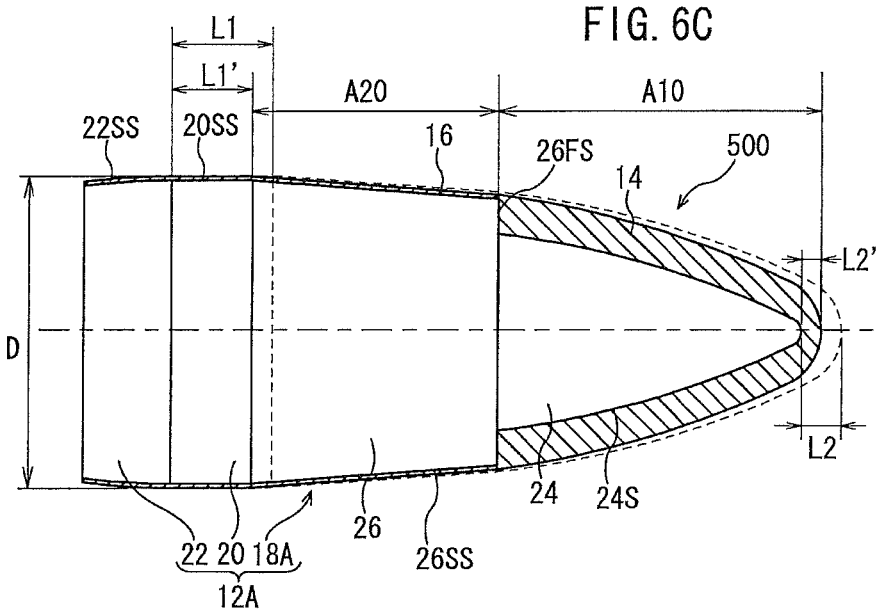
FIG. 6C is a longitudinal section view showing a regenerated plug.

Subsequently, the sprayed film 16 is newly formed in the region where the shotblast is applied (forming step). Specifically, the sprayed film 16 is newly formed on the surface of the plug body 12A in the regions other than the region where the build-up layer 14 is formed. In this step, a plug 500 shown in FIG. 6C is produced. This plug 500 has a shorter axial direction length of the columnar portion 20 compared to that of the plug 50 shown in FIG. 4, but the shape and size of the rolling portion A10 and the reeling portion A20 is the same as those of the plug 50.

In the above regenerating method, it is possible to produce the plug 50 and 500 each of which has the same shape and size of the rolling portion A10 and the reeling portion A20 as well as the same maximum diameter D by equalizing the thickness of the newly formed sprayed film 16 to the thickness of the original sprayed film 16.

At the time of removing the melted portion of the build-up layer 14, the axial direction length of the columnar portion 20 becomes reduced in accordance with the rearward moved distance of the rear end of the second body portion 26 (body 18A). This means that the plug can be regenerated if the rearward moved distance of the rear end of the body 18A is shorter than the axial direction length of the columnar portion 20.

If the thickness L2 of the front end portion of the build-up layer 14 is greater than the axial direction length L1 of the columnar portion 20, the plug 50 may be regenerated immediately before the build-up layer 14 becomes lost. Therefore, the number of regeneration of the plug 50 is increased.

In the above described regenerating method, the shotblast is applied to the regions on the surface of the plug body 12A other than the region where the build-up layer 14 is formed after the used plug is cut, but this shotblast may be omitted.

Third Embodiment

The plug according to an embodiment of the present invention may be configured in any manner as far as the build-up layer is formed on the surface of the body. An example of this is shown in FIG. 7.

Figure 7:
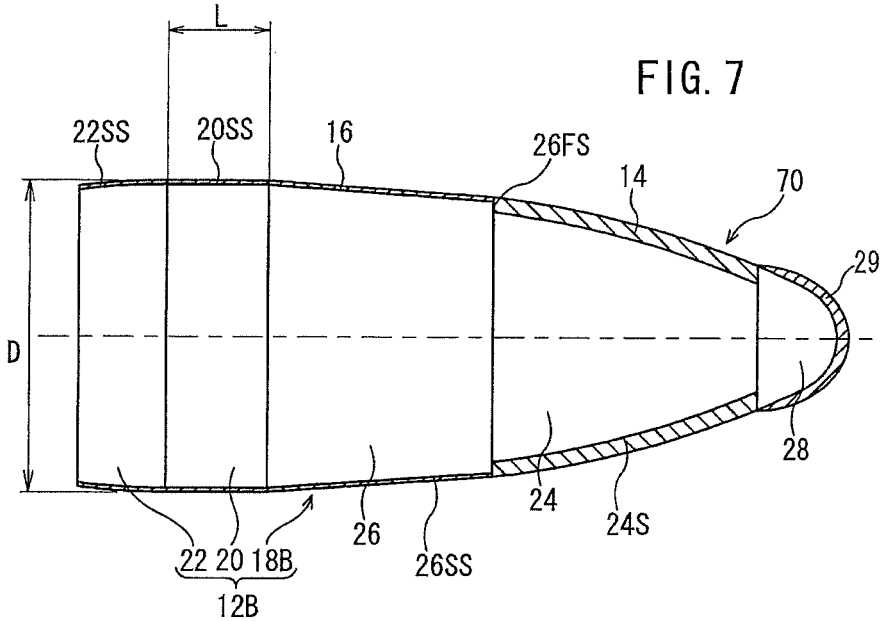
FIG. 7 is a longitudinal section view of a plug according to a third embodiment of the present invention.

FIG. 7 shows a plug 70 according to a third embodiment of the present invention. The plug 70 includes a plug body 12B instead of the plug body 12A. The plug body 12B includes a body 18B instead of the body 18A. The body 18B further includes a projection 28 as well as the first body portion 24 and the second body portion 26. The projection 28 is adjacently disposed in front of the first body portion 24. The diameter of the rear end of the projection 28 is greater than the diameter of the front end of the first body portion 24. Consequently, a groove is formed on the side surface of the plug body 12B between the projection 28 and the second body portion 26 in the circumferential direction. In present embodiment, the build-up layer 14 is formed in this groove. A sprayed film 29 is formed on the surface of the projection 28. The thickness of the sprayed film 29 is 1200 for example.

In the plug 70, the projection 28 is covered with the sprayed film 29. The sprayed film 29 has a wear resistance more excellent than that of the oxide scale. Accordingly, the usage count of the plug 70 is enhanced.

Even if the sprayed film 29 is worn away, a new sprayed film 29 is formed on the plug after the worn sprayed film 29 is removed, thereby regenerating the plug 70. In other words, the plug 70 can be maintained to stay usable.

The billet for use in the piercing-rolling by using the plug 70 may be solid or hollow. That is, the plug 70 may be used for an elongator (second piercing machine). In other words, piercing machines for which the plug 70 may be used include elongators. If a hollow billet is used in the piercing-rolling, the sprayed film 29 may not be formed.

Example 1

[Plug]

Figure 8:
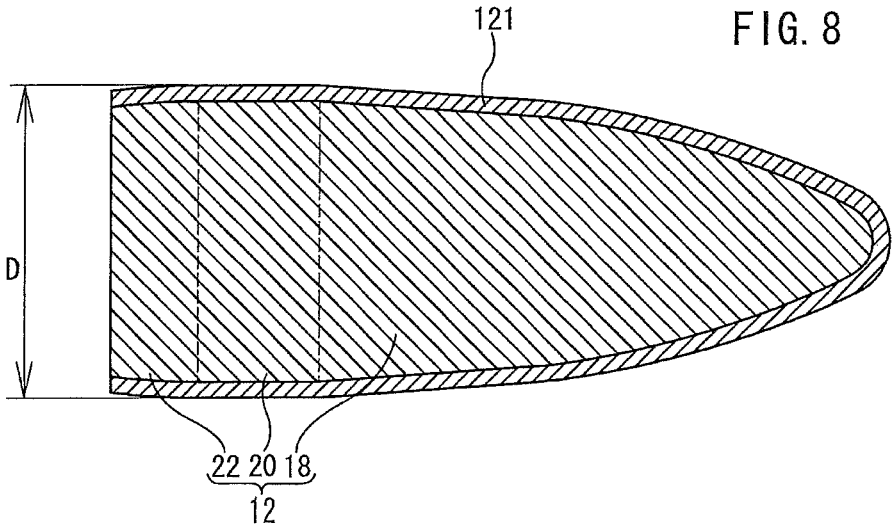
FIG. 8 is a longitudinal section view showing a plug of a comparative example.

There were prepared a plug configured shown in FIG. 1 (inventive example) and a plug configured shown in FIG. 8 (comparative example).

In each plug of the inventive example, the maximum diameter D was 147 mm, the axial direction length of the columnar portion 20 was 12 mm. The sprayed film 16 was formed of the iron and the iron oxide, and was formed by arc-welding an iron wire in the same condition. The content by percentage of the iron oxide in the sprayed film was 20% by volume at the boundary to the plug body, and 70% by volume in the outer layer. The thickness of the sprayed film was 1200 μm in the front end portion, and 400 μm in the other portions.

In the plug of the comparative example, an oxide scale 121 was formed on the surface of the plug body 12. In this plug, the maximum diameter D was 147 mm, and the axial direction length of the columnar portion 20 was 12 mm. The thickness of the oxide scale was approximately 400 μm.

[Test Method]

Billets were piercing-rolled by using the above plugs, and thereafter, variation at the front end, and reduction of the maximum diameter were measured for each plug. Each billet was made of 13 Cr steel, the diameter was 191 mm, and the length was 3000 mm.

In the plug of the inventive example, the variation at the front end and the reduction of the maximum diameter were measured after the piercing-rolling of the first billet, and after the piercing-rolling of the third billet. In the plug of the comparative example, the variation at the front end, and the reduction of the maximum diameter were measured after the piercing-rolling of the first billet.

[Test Results]

Figure 9:
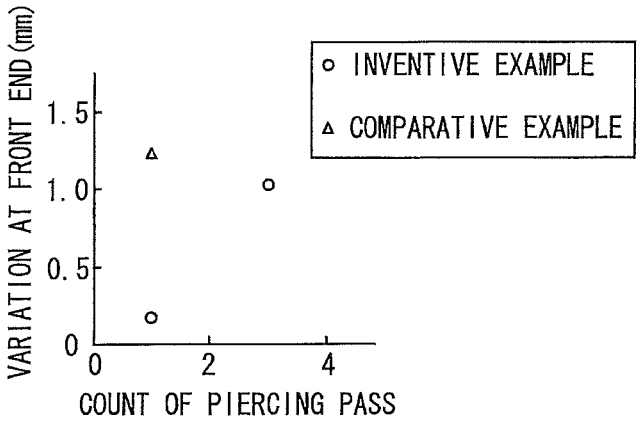
FIG. 9 is a graph showing a relation between the variation at a front end and the count of a piercing pass.
Figure 10:
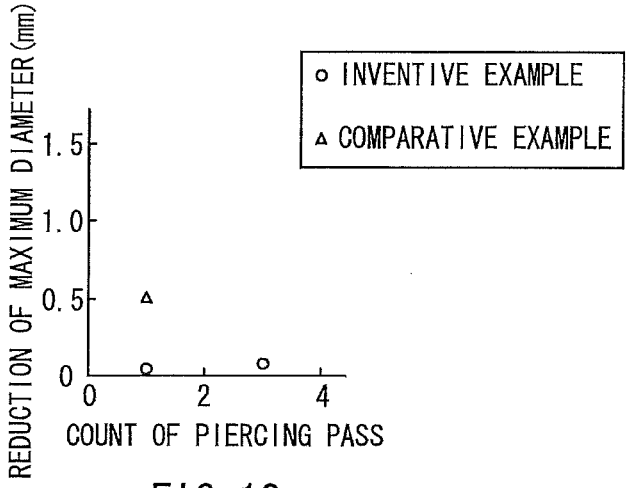
FIG. 10 is a graph showing a relation between the reduction of the maximum diameter and the count of the piercing pass.

The test results are shown in FIG. 9 and FIG. 10. As shown in FIG. 9, in the plug of the inventive example, the variation at the front end was smaller even after three counts of the piercing pass compared to the plug of the comparative example (count of piercing pass: 1). As shown in FIG. 10, the plug of the inventive example had a smaller reduction of the maximum diameter even after three counts of the piercing pass compared to the plug of the comparative example (count of piercing pass: 1).

Example 2

There were prepared plugs of the test numbers 1 to 6 as shown in Table 1.

diameter became 0.5 to 0.8 mm (until the plug regenerating condition was satisfied), so as to evaluate the count of the piercing pass for each plug.

The count of the piercing pass was evaluated based on the count ratio of the piercing pass. This count ratio of the piercing pass was a ratio relative to the count of the piercing pass for the plug having the oxide scale formed on its surface (test number 6), which was defined as 1.

If the plug regenerating condition was satisfied, each plug was regenerated in accordance with the above described regenerating method. In each regeneration, the axial direction length of the columnar portion was reduced by 3 mm from the previous axial direction length. The same sprayed film and the same oxide scale were formed.

The regenerated plugs were used, and the above described test was repetitively conducted on those plugs until their columnar portions were lost.

[Test Results]

Table 1 shows the test results. The count ratio of the piercing pass when the plug of the test number 6 became

TABLE 1

| | Axial Direction Length of Columnar Portion: 12 mm | | Axial Direction Length of Columnar Portion: 9 mm | | Axial Direction Length of Columnar Portion: 6 mm | | Axial Direction Length of Columnar Portion: 3 mm | | Axial Direction Length of Columnar Portion: 0 mm | | Total |
|---|---|---|---|---|---|---|---|---|---|---|---|
| Test number | Count Ratio of Piercing Pass | Regeneration | Count Ratio of Piercing Pass | Regeneration | Count Ratio of Piercing Pass | Regeneration | Count Ratio of Piercing Pass | Regeneration | Count Ratio of Piercing Pass | Regeneration | Count Ratio of Piercing Pass |
| 1 | 7.0 | Regeneratable | 7.5 | Regeneratable | 8.0 | Regeneratable | 7.0 | Regeneratable | 8.0 | Regeneratable | 37.5 |
| 2 | 6.5 | Regeneratable | 7.5 | Regeneratable | 8.0 | Regeneratable | 7.5 | Regeneratable | 8.0 | Regeneratable | 37.5 |
| 3 | 6.5 | Regeneratable | 7.5 | Regeneratable | 7.5 | Regeneratable | 7.0 | Regeneratable | 8.0 | Regeneratable | 36.5 |
| 4 | 7.0 | Regeneratable | 7.5 | Regeneratable | 7.0 | Regeneratable | 7.0 | Regeneratable | 8.0 | Regeneratable | 36.5 |
| 5 | 7.0 | Regeneratable | 7.5 | Regeneratable | 7.5 | Regeneratable | 7.5 | Regeneratable | 7.5 | RegenerataMe | 37.0 |
| 6 | 1.0 | Regeneratable | 1.0 | Unregeneratable | | | | | | | 2.0 |

[Plug]

In each plug of the test numbers 1 to 5, the sprayed film 16 was formed on the surface of the plug body 12 as shown in FIG. 1. In each plug, the maximum diameter D was 147 mm, and the axial direction length of the columnar portion 20 was 12 mm. The sprayed film 16 was formed of the iron and the iron oxide, and was formed by arc-welding the iron wire in the same condition. The content by percentage of the iron oxide in the sprayed film was 20% by volume at the boundary to the plug body, and 70% by volume in the outer layer. The thickness of the sprayed film was 1200 μm in the front end portion, and 400 μm in the other portions.

In the plug of the test number 6, as shown in FIG. 8, the oxide scale 121 was formed on the entire surface of the plug body 12. In this plug, the maximum diameter D was 147 mm, and the axial direction length of the columnar portion 20 was 12 mm. The thickness of the oxide scale was approximately 400 μm.

[Test Method]

Billets were piercing-rolled by using the plugs in the test numbers 1 to 6, and thereafter, variation at the front end, and reduction of the maximum diameter were measured for each plug. Each billet was made of 13 Cr steel, the diameter was 191 mm, and the length was 2200 mm.

The piercing-rolling was repetitively performed to the billet until the variation at the front end, that is, the melting loss (reduction of the plug in the axial direction) became 2.5 mm to 3.0 mm, or until the reduction of the maximum unusable (i.e. when the axial direction length of the columnar portion of each plug became 6 mm, 3 mm, and 0 mm) was a ratio relative to the count of the piercing pass for the plug of the test number 6 having the axial direction length of the columnar portion of 12 mm, which was defined as 1. The total count ratio of the piercing pass was a sum of the count ratios of the piercing pass for the plug of each test number.

In each plug of the test numbers 1 to 5, the count ratio of the piercing pass until the plug regenerating condition was satisfied was 6.5 at least, which was higher than the count ratio of the piercing pass for the plug of the test number 6. The plugs of the test numbers 1 to 5 could be regenerated four times. The total count ratio of the piercing pass for each plug of the test numbers 1 to 5 was 36.5 at least, which was higher than that for the plug of the test number 6.

To the contrary, in the test number 6, the reduction of the maximum diameter of the plug after repeating the test (i.e., piercing-rolling) was significant, and the plug could be regenerated only once. The oxide scale is generated by oxidizing the surface of the plug base metal; thus the wear of the oxide scale causes reduction of the maximum diameter of the plug base metal. Consequently, in the test number 6, the plug could be regenerated only once although the columnar portion of this plug still remained. Specifically, the reduction of the maximum diameter of the plug was so significant that the plug became unusable as the plug having the same size any more.

Example 3

[Plug]

There were prepared a plug configured shown in FIG. 4 (inventive example 1), a plug configured shown in FIG. 1 (inventive example 2), and a plug configured shown in FIG. 8 (comparative example).

In the plug of the inventive example 1, the maximum diameter D was 147 mm, and the axial direction length of the columnar portion 20 was 12 mm. The build-up layer 14 was formed by the PTA process, and was formed of a stellite 6 alloy containing NbC of 50% by mass. The thickness of the build-up layer was 7 mm. The sprayed film 16 was formed of the iron and the iron oxide, and was formed by arc-welding the iron wire in the same condition. The content by percentage of the iron oxide in the sprayed film was 20% by volume at the boundary to the plug body, and 70% by volume in the outer layer. The thickness of the sprayed film was 400 μm.

In the plug of the inventive example 2, the sprayed film 16 was formed on the surface of the plug body 12. The axial direction length of the columnar portion 20 was 12 mm. The maximum diameter D of the plug was 147 mm. The sprayed film was formed of the iron and the iron oxide, and was formed by arc-welding the iron wire in the same condition. The content by percentage of the iron oxide in the sprayed film was 20% by volume at the boundary to the plug body, and 70% by volume in the outer layer. The thickness of the sprayed film was 1200 μm in the front end portion, and 400 μm in the other portions of the plug.

In the plug of the comparative example, the oxide scale 121 was formed on the surface of the plug body 12. The axial direction length of the columnar portion 20 was 12 mm. The maximum diameter D of the plug was 147 mm. The thickness of the oxide scale was approximately 400 μm.

[Test Method]

Billets were piercing-rolled by using these plugs, and thereafter, variation at the front end, and reduction of the maximum diameter were measured for each plug. Each billet was formed of 13 Cr steel, the diameter was 191 mm, and the length was 3000 mm.

In the plug of the inventive example 1, the variation at the front end, and the reduction of the maximum diameter were measured after the piercing-rolling of the fifth billet. In the plug of the inventive example 2, the variation at the front end, and the reduction of the maximum diameter were measured after the piercing-rolling of the first billet, and after the piercing-rolling of the third billet. In the plug of the comparative example, the variation at the front end, and the reduction of the maximum diameter were measured after the piercing-rolling of the first billet.

[Test Results]

Figure 11:
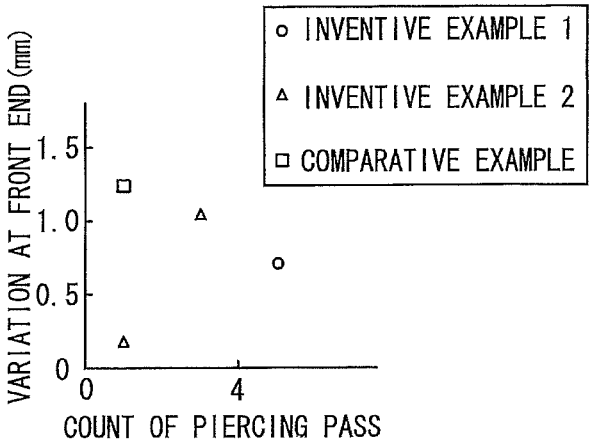
FIG. 11 is a graph showing a relation between the variation at the front end and the count of the piercing pass.
Figure 12:
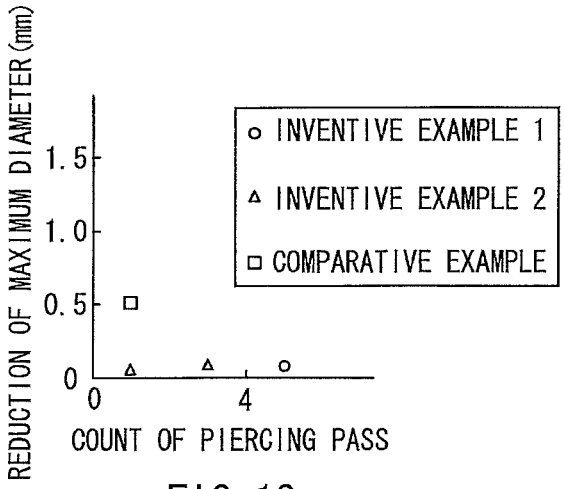
FIG. 12 is a graph showing a relation between the reduction of the maximum diameter and the count of the piercing pass.

The test results are shown in FIG. 11 and FIG. 12. As shown in FIG. 11, in the plug of the inventive example 1, the variation at the front end was smaller even after the five counts of the piercing pass, compared to the plug of the inventive example 2 and the plug of the comparative example. As shown in FIG. 12, in the plug of the inventive example 1, the reduction of the maximum diameter was smaller than the plug of the comparative example even after the five counts of the piercing pass. As shown in FIG. 12, in the plug of the inventive example 2, the reduction of the maximum diameter was smaller than the plug of the comparative example even after the three counts of the piercing pass.

Example 4

There were prepared plugs of the test numbers 1 to 4 as shown in Table 2.

TABLE 2

| | Axial Direction Length of Columnar Portion: 12 mm | | Axial Direction Length of Columnar Portion: 9 mm | | Axial Direction Length of Columnar Portion: 6 mm | | |
|---|---|---|---|---|---|---|---|
| Test number | Count Ratio of Piercing Pass | Regeneration | Count Ratio of Piercing Pass | Regeneration | Count Ratio of Piercing Pass | Regeneration | Total Count Ratio of Piercing Pass |
| 1 | 15.0 | Regeneratable | 14.5 | Regeneratable | 15.5 | Regeneratable | 45.0 |
| 2 | 9.5 | Regeneratable | 10.5 | Regeneratable | 10.0 | Regeneratable | 30.0 |
| 3 | 9.0 | Regeneratable | 7.0 | Regeneratable | 8.0 | Regeneratable | 24.0 |
| 4 | 1.0 | Regeneratable | 1.0 | Unregeneratable | | | 2.0 |

[Plug]

In the plug of the test number 1, the build-up layer 14 was formed on the surface of the first body portion 24, and the sprayed film 16 was formed on the other portions (the second body portion 26, the columnar portion 20, and the rear end portion 22), as shown in FIG. 4. In the plug of the test number 2, the build-up layer was formed on the surface of the first body portion 24, and the sprayed film 16 was formed on the other portions (the projection 28, the second body portion 26, the columnar portion 20, and the rear end portion 22), as shown in FIG. 7. In each plug, the axial direction length of the columnar portion 20 was 12 mm. The maximum diameter D of each plug was 147 mm. The build-up layer 14 was formed by the PTA process. The build-up layer was formed of a stellite 6 alloy containing NbC of 50% by mass. The thickness of the build-up layer was 7 mm. Each sprayed film 16 of the test numbers 1 and 2 was formed of the iron and the iron oxide, and was formed by arc-welding the iron wire in the same condition. The content by percentage of the iron oxide in the sprayed film was 20% by volume at the boundary to the plug body, and 70% by volume in the outer layer. The thickness of the sprayed film of the test number 1 was 400 μm. The thickness of the sprayed film of the test number 2 was 1200 μm in the front end portion, and 400 μm in the other portions.

In the plug of the test number 3, the sprayed film 16 was formed on the surface of the plug body 12, as shown in FIG. 1. In this plug, the axial direction length of the columnar portion 20 was 12 mm. The maximum diameter D of the plug was 147 mm. The sprayed film 16 was formed of the iron and the iron oxide, and was formed by arc-welding the iron wire in the same condition. The content by percentage of the iron oxide in the sprayed film was 20% by volume at the boundary to the plug body, and 70% by volume in the outer layer. The thickness of the sprayed film was 1200 μm in the front end portion, and 400 μm in the other portions.

In the plug of the test number 4, the oxide scale 121 was formed on the surface of the plug body 12, as shown in FIG. 8. In this plug, the axial direction length of the columnar portion 20 was 12 mm. The maximum diameter D of the plug was 147 mm. The thickness of the oxide scale 121 was approximately 400 μm.

[Test Method]

Billets were piercing-rolled by using the plugs of the test numbers 1 to 4, and thereafter, variation at the front end, and reduction of the maximum diameter were measured for each plug. Each billet was formed of 13 Cr steel, the diameter was 191 mm, and the length was 2200 mm.

The piercing-roll of billets was repetitively performed until the variation at the front end, that is, the melting loss (reduction of the plug in the axial direction) became 2.5 mm to 3.0 mm, or until the reduction of the maximum diameter became 0.5 to 0.8 mm (until the plug regenerating condition was satisfied), so as to evaluate the count of the piercing pass for each plug.

The count of the piercing pass was evaluated based on the count ratio of the piercing pass. This count ratio of the piercing pass was a ratio relative to the count of the piercing pass for the plug having the oxide scale formed on its surface (test number 4) until the regeneration was necessary for this plug, which was defined as 1.

If the plug regenerating condition was satisfied, each plug was regenerated in accordance with the above described regenerating method. At this time, the axial direction length of the columnar portion was reduced by 3 mm from the previous axial direction length. The same sprayed films and oxide scales were formed.

The regenerated plugs were used, and the above described test was repetitively conducted on those plugs. The regeneration of each plug was conducted until the axial direction length of its columnar portion became to be 6 mm.

[Test Results]

The test results are shown in Table 2. The count ratio of the piercing pass when the plug of the test number 4 became unusable (i.e., when the axial direction length of the columnar portion of each plug became 6 mm) was a ratio relative to the count of the piercing pass for the plug of the test number 4 having the axial direction length of the columnar portion of 12 mm, which was defined as 1. The total count ratio of the piercing pass was a sum of the count ratios of the piercing pass for the plug of each test number.

In each plug of the test numbers 1 and 2, the count ratio of the piercing pass until the plug regenerating condition was satisfied was 9.5 at least, which was higher than the count ratio of the piercing pass in each plug of the test numbers 3 and 4. In the test numbers 1 and 2, the plug could be regenerated twice. In each plug of the test numbers 1 and 2, the total count ratio of the piercing pass was 30.0 at least, which was higher than the total count ratio of the piercing pass in each plug of the test numbers 3 and 4. In the plug of the test number 3, the count ratio of the piercing pass until the plug regenerating condition was satisfied was 7.0 at least, which was smaller than those in the test numbers 1 and 2, but higher than that in the test number 4. In the test number 3, the plug could be regenerated twice. In the test number 3, the total count ratio of the piercing pass was 24.0 at least, which was smaller than those in the test numbers 1 and 2, but higher than that in the test number 4. In the test number 4, the reduction of the maximum diameter of the plug having experienced repeating the test (i.e., piercing-rolling) was significant, and the plug could be regenerated only once. The oxide scale is generated by oxidizing the surface of the plug base metal; thus the wear of the oxide scale reduces the maximum diameter of the plug base metal. Consequently, the plug in the test number 4 could be regenerated only once although the columnar portion of this plug still remained. Specifically, the reduction of the maximum diameter of the plug was so significant that the plug could not be used as the plug having the same size any more.

The embodiments of the present invention have been described in detail, but these are merely examples of the present invention, and the present invention is not limited by the above described embodiments.

The invention claimed is:

1. A regenerating method of a plug for use in a piercing machine for piercing-rolling a billet, the plug including:

a body having a maximum diameter at a rear end of the body;

a columnar portion having the same diameter as a diameter of the rear end of the body, the columnar portion extending from the rear end of the body; and a sprayed film formed on a surface of the body, and on a surface of the columnar portion, and the regenerating method comprising:

a preparing step of preparing the plug used in the piercing-rolling, a cutting step of cutting the plug so as to remove the sprayed film, and shifting the rear end of the body more rearward compared to the plug before the cutting step, and reducing the axial direction length of the columnar portion to restore an original shape and size of the body; and a forming step of newly forming the sprayed film on the surface of the body, and on the surface of the columnar portion after the cutting step.

2. The regenerating method according to claim 1, wherein an entire surface of the body is covered with the sprayed film, and in the forming step, the sprayed film is newly formed on the entire surface of the body, and on the surface of the columnar portion.

3. The regenerating method according to claim 2, further comprising a step of applying a shotblast on the entire surface of the body, and on the surface of the columnar portion before the forming step and after the cutting step.

4. The regenerating method according to claim 1, wherein the plug further includes a build-up layer formed on the surface of the body, the sprayed film is formed on the surface of the body in a region more rearward than the build-up layer, and on the surface of the columnar portion, and in the forming step, the sprayed film is newly formed on the surface of the body in the region more rearward than the build-up layer, and on the surface of the columnar portion.

5. The regenerating method according to claim 4, further comprising a step of applying a shotblast in the region on the surface of the body more rearward than the build-up layer, and on the surface of the columnar portion before the forming step and after the cutting step.

* * * * *